US008635939B2

(12) United States Patent
Linjama et al.

(10) Patent No.: US 8,635,939 B2
(45) Date of Patent: Jan. 28, 2014

(54) APPARATUS, A CONTROL CIRCUIT AND A METHOD FOR PRODUCING PRESSURE AND VOLUME FLOW

(75) Inventors: Matti Linjama, Valkkinen (FI); Jyrki Tammisto, Tampere (FI); Kalevi Huhtala, Tampere (FI); Matti Vilenius, Tampere (FI)

(73) Assignee: Robert Bosch GmbH, Stuttgart (DE)

( * ) Notice: Subject to any disclaimer, the term of this patent is extended or adjusted under 35 U.S.C. 154(b) by 807 days.

(21) Appl. No.: 12/918,930

(22) PCT Filed: Mar. 24, 2009

(86) PCT No.: PCT/FI2009/050219

§ 371 (c)(1),
(2), (4) Date: Aug. 23, 2010

(87) PCT Pub. No.: WO2009/118452

PCT Pub. Date: Oct. 1, 2009

(65) Prior Publication Data

US 2011/0017308 A1 Jan. 27, 2011

(30) Foreign Application Priority Data

Mar. 25, 2008 (FI) ..... 20085242

(51) Int. Cl.
*F01B 3/00* (2006.01)

(52) U.S. Cl.
USPC ..... 91/6.5; 91/19; 91/465

(58) Field of Classification Search
USPC ..... 91/420, 461, 6.5, 19, 24, 474, 454, 465; 60/421; 417/270, 2, 375, 379, 390
See application file for complete search history.

(56) References Cited

U.S. PATENT DOCUMENTS

| | | | | |
|---|---|---|---|---|
| 6,681,571 | B2 | 1/2004 | Bailey et al. | |
| 2003/0037545 | A1 | 2/2003 | Schienbein et al. | |
| 2006/0054015 | A1 * | 3/2006 | Klother et al. | 91/461 |

FOREIGN PATENT DOCUMENTS

| | | | |
|---|---|---|---|
| EP | 0 494 236 | B1 | 12/1995 |
| EP | 1 537 333 | B1 | 6/2006 |
| WO | WO 2008/009950 | A1 | 1/2008 |

OTHER PUBLICATIONS

International Preliminary Report on Patentability issued in Patent Application No. PCT/FI2009/050219, dated May 5, 2010.

(Continued)

*Primary Examiner* — Edward Look
*Assistant Examiner* — Logan Kraft
(74) *Attorney, Agent, or Firm* — Oliff & Berridge, PLC

(57) ABSTRACT

An apparatus comprising: a series of units, each being capable of producing a volume flow; a first channel for supplying hydraulic fluid into the apparatus; a second channel for supplying hydraulic fluid from the apparatus; a first series of valves comprising at least one controlled valve for each unit; a third channel for supplying hydraulic fluid from the apparatus; and several controlled auxiliary valves, each being provided for one unit. The control circuit also comprises: at least one actuator for converting hydraulic energy to mechanical energy, wherein said actuator is at least connected to either the second channel or the third channel; and a control device configured to synchronize the operation of the valves of the first series of valves and said auxiliary valves with the operation of said units, and to control the actuator by means of pressure and volume flow. In the method, the operation of the first series of valves and said auxiliary valves is synchronized with the operation of said units, and controlling the pressure and the volume flow in a predetermined manner, for controlling one or more actuators by means of a control device.

24 Claims, 8 Drawing Sheets

(56) References Cited

OTHER PUBLICATIONS

International Search Report issued in Patent Application No. PCT/FI2009/050219, dated Jul. 14 2009.

Opposition issued in Finnish Patent Application No. 20085242 dated May 4, 2011 (with translation).

* cited by examiner

APPARATUS, A CONTROL CIRCUIT AND A METHOD FOR PRODUCING PRESSURE AND VOLUME FLOW

FIELD OF THE INVENTION

The invention relates to an apparatus. The invention also relates to a control circuit. Furthermore, the invention relates to a method for producing pressure and volume flow.

BACKGROUND OF THE INVENTION

According to prior art, hydraulics is used for controlling various actuators, the most common being cylinders and motors. In hydraulics, substantially incompressible hydraulic fluid is utilized, whose more precise composition varies and which is used as a pressurized medium. The volume flow of hydraulic fluid is used to produce a linear movement of a cylinder, when the hydraulic fluid is led into a chamber accommodating a movable piston and a piston rod, or a rotary movement of a motor, when the hydraulic fluid is led through the motor. The cylinder and the motor have a speed of movement and a speed of rotation, respectively, that is dependent on the volume flow. The piston of the cylinder also has a force that is dependent on the pressure of the hydraulic fluid supplied into the chamber. The shaft of the motor has a torque that is dependent on the pressure of the hydraulic fluid effective over the motor. In this way, it is possible to control various apparatuses at a desired speed and with a desired force or torque.

The volume flow and pressure of the hydraulic fluid are produced in a known way by means of an apparatus that is most commonly used as a pump. In many cases, the same apparatus can be used as a motor or a pump, on whose shaft a driving device is mounted, usually an electric motor that rotates the apparatus. By means of a hydraulic pump, mechanical energy (torque, rotational speed) is converted to hydraulic energy (volume flow, pressure). There are several types of pumps, but in this case, especially the axial piston pump and the radial piston pump are mentioned, which operate by the principle of displacement.

The above-mentioned pumps comprise several chambers operating in cycles and with a phase shift with each other, wherein, as their sum, an almost steady volume flow is achieved on the pressure side of the pump and in its outlet. A piston moves back and forth in the chamber in a sealed manner, sucking hydraulic fluid into the expanding chamber from the suction side and the suction inlet through a suction valve that is opened by underpressure. As the piston reduces the volume of the chamber, the pressure of the hydraulic fluid is increased and it is led onto the pressure side via a pressure control valve that is opened by pressure. By controlling the movement of each piston in such a way that the volume displaced by it varies, it is also possible to control the total volume flow produced by the pump.

The pressure side of the pump can be coupled via a suitable control valve, for example, to the cylinder chamber or motor. From the cylinder and the motor, the hydraulic fluid is transferred further to a tank line or a tank connected to the suction side of the pump.

FIG. 1 shows a system of prior art, comprising a pump and two actuators, as well as two control valves. This is a so-called load sensing (LS) system with an adjustable displacement pump. The volume flow produced by the pump can be divided between two cylinders. The volume flow is dependent on the pressure difference effective over the control valve and on the position of the control valve. However, such systems involve the problem that the pressure of the whole system is determined by the actuator requiring the highest pressure. For this reason, the pressure is unnecessarily high for the other actuators, resulting in unnecessary pressure losses and wasting of energy.

FIG. 2 shows a system, in which each actuator is controlled by a separate adjustable displacement pump, wherein also their pressure sides are unconnected. The pressures of the system can be selected separately for each actuator, but the problem is that several pumps are needed, which increases the costs and the size of the system.

Document EP 1537333 B1 discloses a pump, by which actuators can be controlled in a more versatile way. The inlet valve and the pressure control valve relating to each capacity can be electrically controlled so that each piston can be entered in various modes. In the different modes, each piston is either running idle, in which case it does not produce a volume flow or pressure, or each piston may produce a varying quantity of volume flow depending on how long and in which phase of the piston movement the pressure control valve is open. Consequently, the volume flow produced by the piston can be led either partly or in whole back via the inlet valve. By means of said function, it is possible to control the total volume flow produced by the motor. The control is implemented by means of an intelligent valve-controlling control device according to the volume flow required at each moment.

Using the pump of EP 1537333 B1, it is not possible to eliminate the problems relating to the high pressure level shown in FIGS. 1 and 2, even if the volume flow produced by the pump can be controlled on the pressure side. Document U.S. Pat. No. 6,681,571 B2 also discloses an apparatus used as a pump and a motor, having two ports which can be used either as pressure inlets or suction inlets. The chambers operating by the displacement principle comprise two electrically controlled valves for controlling the quantity and direction of the volume flow. When part of the chambers is not in operation, the valves being closed, it is possible to control the total volume flow produced by the apparatus.

BRIEF SUMMARY OF THE INVENTION

It is an aim of the invention to eliminate drawbacks presented above.

The apparatus according to the invention for producing pressure and volume flow will be presented in claim 1. The control circuit according to the invention will be presented in claim 15. The method according to the invention for producing pressure and volume flow will be presented in claim 21.

The aim of the invention is to implement the separate and independent control of several actuators, when necessary, by using, for example, one apparatus for producing pressure and volume flow. The apparatus is also suitable for controlling a single actuator. With the apparatus, a good efficiency is achieved even if different pressure levels were prevailing in different parts of the system controlled by the apparatus.

According to an example, the apparatus comprises several hydraulic units, each being connected to at least two ports which can be coupled to an actuator and have a controlled valve each. The valves can be used to control the quantity and the direction of the volume flow for each unit. Each unit comprises at least three functional modes. Each unit is capable of producing volume flow to the ports, wherein the unit is used as a pump, and receiving volume flow from the ports, wherein the unit can, if desired, utilize hydraulic energy in its operation, as well as of running idle or on free circulation, wherein the unit does not produce volume flow to the ports nor receive volume flow via the ports.

In some examples, the unit produces continuously a volume flow that is, during idle running, supplied at a low pressure back into, for example, a tank. In addition to the two valves mentioned above, each unit comprises one or more controlled valves for implementing the control of the volume flow so that the above-mentioned three functional modes are possible.

In an example, the unit is capable of operating at any moment of time in any of the three functional modes, but according to another example of the invention, the unit is capable of operating at a given moment of time in a given functional mode only. The operation is dependent on the devices applied in the unit, or on the cyclic feature of the operation.

In an example, the unit comprises several chambers operating by the principle of displacement, in which a member used as a piston is moving and which are each connected to at least two ports for an actuator.

In another example, the unit comprises several operating pumps, each being connected to at least two ports for an actuator.

In a first embodiment of the invention, units or devices are used which enable at least the production of volume flow and idle running and which are connected to at least two pressure control valves. In a second embodiment of the invention, units or devices are used which enable at least the production of volume flow and idle running as well as the receiving of a volume flow, and which are connected to at least two pressure control valves.

In an example of the invention, the apparatus comprises several units operating in a cyclic manner and producing, in a combination, the desired total volume flow that can be supplied to an actuator. Thanks to the intelligent control of valves, pressure and volume flow can be supplied from all the units or only a part of the units, as needed.

In an example of the invention, the apparatus comprises several units which can be driven in such a way that some of the units produce pressure and volume flow and some receive a volume flow from an actuator. The received hydraulic energy is converted to mechanical energy by means of the unit, wherein savings are obtained, when the energy is utilized in the driving device or mechanism for moving the unit. In an example, the apparatus is capable of operating, on one hand, as a pump and, on the other hand, as a motor, depending on the direction of flow of the hydraulic fluid.

In an example of the invention, the unit is capable of supplying volume flow to at least two ports, each comprising a controlled valve. Furthermore, depending on the structure of the unit, the unit comprises either a valve or a channel equipped with a non-return valve, through which the hydraulic fluid is sucked into the unit. If necessary, the unit also comprises other valves for different functional modes.

The apparatus according to the example is capable of independently controlling at least two separate actuators, each being connected to the unit via a separate controlled valve. With the apparatus, two different pressure levels are achieved in such control circuits of the actuators that are coupled to said valves. Two different pressure levels are achieved, when said valves, used as pressure valves, do not couple the different control circuits to the same unit simultaneously. In each control circuit, the pressure is determined according to the load or, for example, according to the setting of a pressure relief valve. A significant advantage of the operation is saving in energy, because in the control circuit it is possible to use a pressure level that is only determined according to the need and optimized for the single actuator in question.

In an example of the invention, two pressure control valves can also be utilized in such a way that the hydraulic fluid entering the actuator is supplied from the unit via a first pressure control valve, and the hydraulic fluid returned from the actuator is sucked or fed back into the same unit via a second pressure control valve. The pressure control valves are open at different times. Typically, the hydraulic fluid is arranged to be received by another unit. In another possible arrangement, the same unit either supplies or receives hydraulic fluid alternately and in synchronization with another unit in different phases of the cyclic operation.

In an example of the invention, the operation of a suction valve and two or more pressure control valves is controlled in a manner synchronized and coordinated with the internal functionality of the unit. One alternative is thus to provide chambers operating on the principle of displacement and the synchronization with the movement of the pistons in the chambers. In this way, a suction flow from a tank or a return flow from a selected control circuit into a given unit is produced at a given moment of time, for example when the piston is moving and the chamber is expanding. Furthermore, at a given moment of time, the flow of pressurized hydraulic fluid is also produced from a given unit into a selected control circuit or returning into a tank, for example when the piston is retracting and the chamber is becoming smaller.

Synchronization with the internal functionality of the unit will not be necessary, or there will be less need for it, if the unit comprises a pump, for example a gear pump or a vane pump, that produces a continuous volume flow.

The electronic control is implemented with a control device in which the necessary control algorithm is stored. In an example, said algorithm runs in a synchronized manner by means of the cyclic operation of the unit. The control is based either on the production of a predetermined pressure and volume flow supplied into a predetermined control circuit, or a feedback coupling in the way of load-sensing systems, wherein, for example, the volume flow is controlled dynamically. The volume flow is controlled, for example, by switching off predetermined units. The control is implemented by controlling the positions of the valves connected to the apparatus. The valves are, for example, simple, normally closed 2/2-valves which are electronically controlled and sufficiently fast in operation. With respect to the control device, it is possible to apply control devices of prior art which are based on, for example, a microprocessor and are suitable for the control of controlled suction valves and pressure control valves. The control device is modified in such a way that the operation of one or more added valves is taken into account, for example, in the timing and in that the predetermined unit controls, at each moment of time, only one of the actuators connected to the apparatus. The production and control of volume flow and pressure in cooperation by several units are, however, premised on basic principles already known as such, wherein the more detailed implementation of the control device, the selection of components and the programming will be obvious for a person skilled in the art on the basis of the description of the operation in this specification.

The alternating and cyclic operation of the units is achieved, for example, by a driving device whose principles follow, for example, the operation of known radial and axial piston pumps. In one embodiment, the units are also mounted on a common drive shaft. The drive shaft is rotated, for example, by an electric motor.

In an example of the invention, several units and the driving device are placed in the same frame structure that constitutes a pump and/or a motor, that is, a hydraulic machine. The frame structure comprises at least two ports on the pressure side and one port on the suction side. The ports of the pressure side can be coupled to either a control circuit for a single actuator or a control circuit for two independent actuators.

In an example of the invention, the units consist of separate or unconnected parts whose operation is controlled in a centralized manner. For example, each chamber can be controlled by a separate driving device which is controlled in a centralized manner to secure synchronized operation.

An advantage of the invention lies in the versatile uses of the apparatus for controlling one or several actuators by means of an either closed or open circuit. Another advantage is the savings in energy, even if the pressure levels in the different parts of the controlled system were different. Another advantage is the increase in energy savings, if the apparatus utilizes the return flow from the actuator. Yet another advantage is the possibility of very different types of control, combined with, for example, intelligent control, which may also dynamically take into the account the need for pressure and volume flow in the control circuits, for example, by means of sensors and feedback couplings.

BRIEF DESCRIPTION OF THE DRAWINGS

In the following, the invention will be described by means of an example and with reference to the appended drawings, in which.

MORE DETAILED DESCRIPTION OF THE INVENTION

Figure 1:
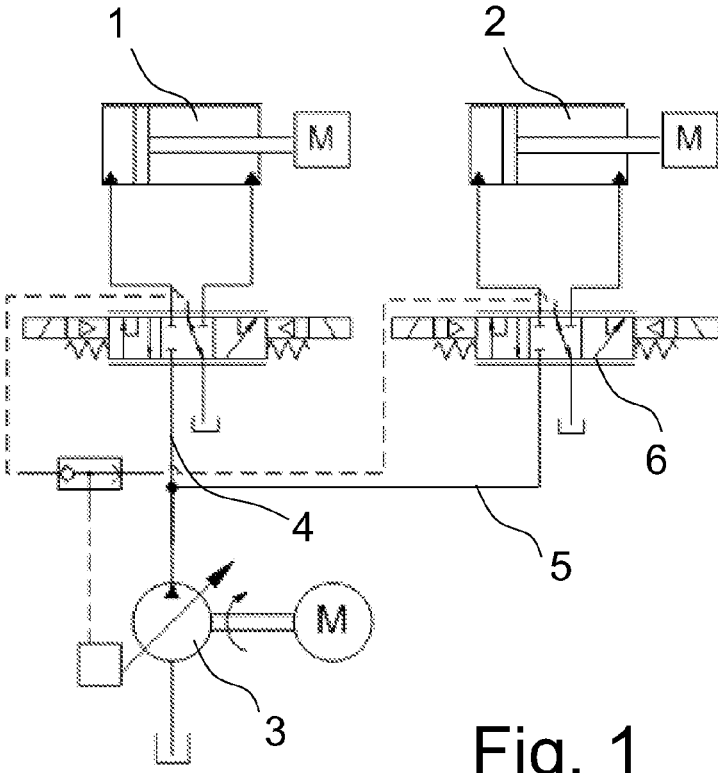
FIG. 1 shows a control circuit of prior art, comprising two actuators.
Figure 2:
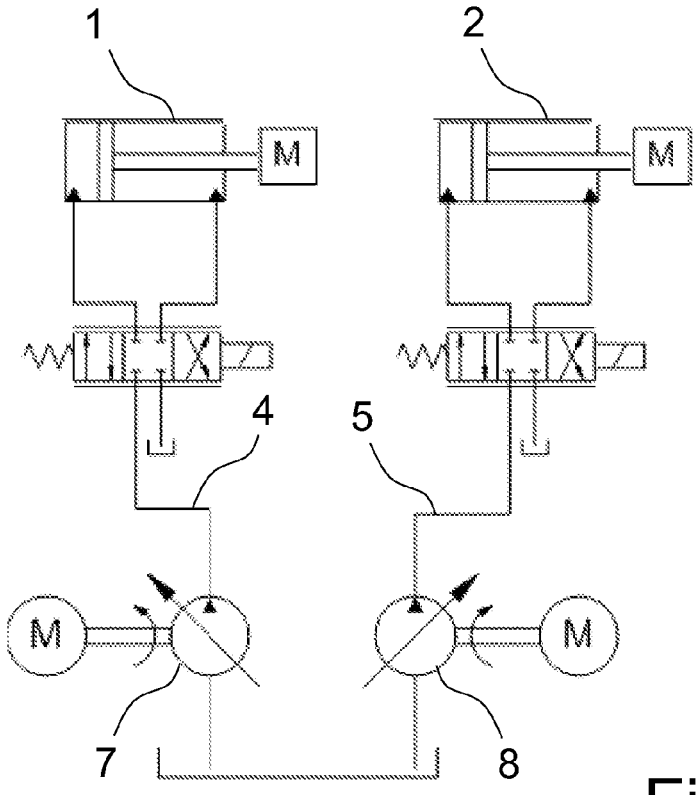
FIG. 2 shows some separate control circuits of prior art comprising a single actuator.

FIGS. 1 and 2 show some systems of prior art, in which actuators 1 and 2 are controlled by pressure and volume flow obtained from a pump 3. The actuators 1, 2 are double-acting cylinders whose direction of movement is controlled by two separate control valves.

According to FIG. 1, lines 4, 5 are connected to each other and to a port on the pressure side of the pump 3. The pressure level of lines 4 and 5 is the same, and it is determined, for example, according to the need of the actuator 1. If the actuator 2 needs, for its operation, a lower pressure level, then an unnecessary pressure loss is inevitably produced in a control valve 6.

According to FIG. 2, the lines 4 and 5 are not connected to each other, and each of them is connected to a separate pump 7 or 8. The pressure level of the lines 4 and 5 may now be different, but two separate pumps are needed.

Figure 3:
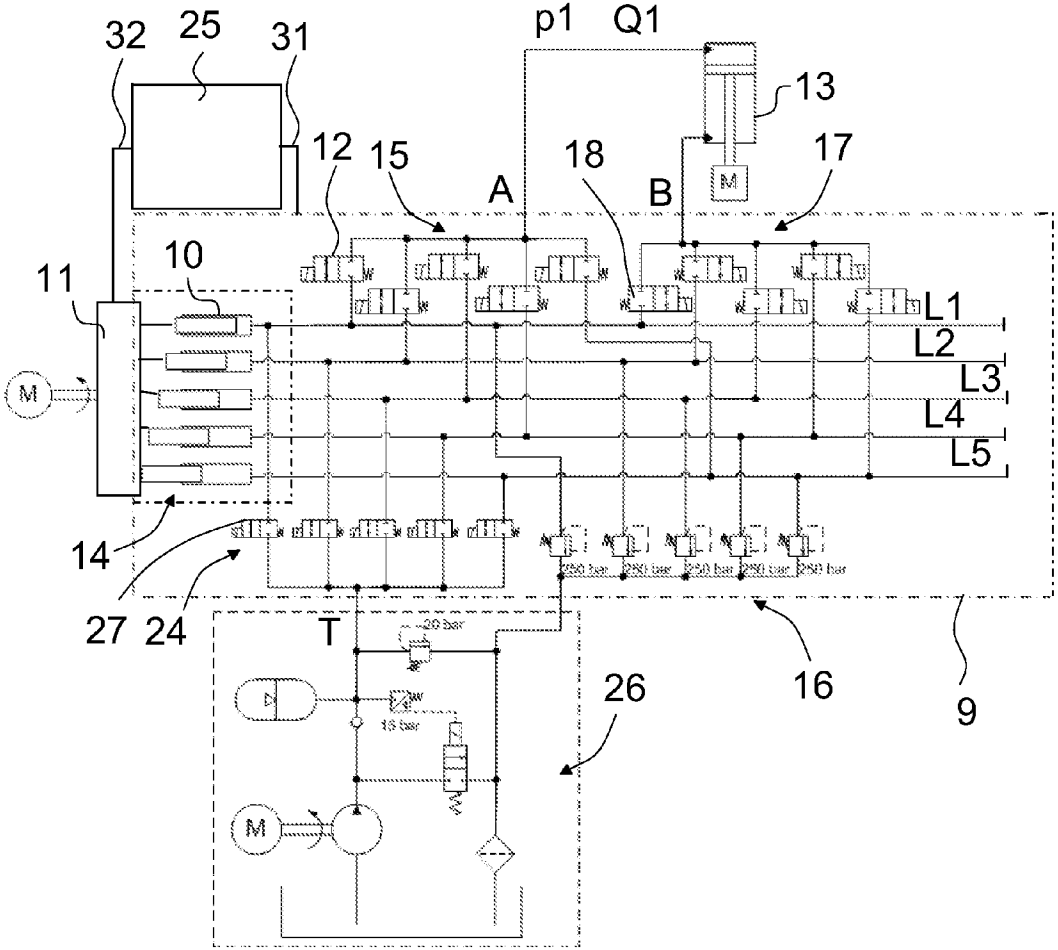
FIG. 3 shows an apparatus and a system according to an example of the invention.

FIG. 3 shows an apparatus 9 and a control system according to the invention. The apparatus 9 applies units whose operation is based on chambers operating by the principle of displacement. The apparatus typically comprises a series of or several chambers 10, in which a piston or a corresponding displacement member is moving in a sealed manner, causing the reduction and expansion of the chamber between maximum and minimum values (lower dead centre and upper dead centre), preferably in a cyclic and e.g. sinusoidal manner. Cyclic operation refers to the continuous repetition of the operation of the chamber 10, for example a continuous reciprocating movement of the piston in the time domain, or as a function of the rotational angle of the driving shaft. Alternatively, the displacement member is stationary and the chamber moves in a cyclic manner. Normally, several chambers are provided, because there are fewer variations in the total volume flow, for example in channel A (port A) when the number of chambers is increased and there are several chambers in different phases. The pistons are controlled by a driving device 11. The driving device 11 may be based, for example, on an angled shaft, an angled plate, a shaft drive, or several different drives. The driving device 11 controls the phase of each piston. Typically, the driving device also comprises an electric motor.

Each chamber is connected to one of lines L1, L2, L3, L4, or L5, to which also a control valve 12 is coupled, which in this example is used as a pressure control valve when a load is moved downwards by an actuator 13. A corresponding coupling is also provided for other chambers in a functional block 14, one of the control valves of a functional block 15 being coupled to each chamber. The control valves pass hydraulic fluid into the channel A and produce a volume flow Q1 and a pressure p1 that is dependent on the load of the actuator 13. If necessary, the maximum pressure level of each line L1-L5 can be limited, for example, by a functional block 16 that comprises, for example, a pressure relief valve for each line. In some cases, two chambers in the same phase may also have one common pressure control valve.

In the example of FIG. 3, the apparatus 9 must also be capable of receiving a returning volume flow from the actuator 13, which will be described in more detail further below.

The chamber 10 is connected to a tank, a suction line or, for example, a circuit 26 for supplying hydraulic fluid, as shown in FIG. 3. The circuit 26 comprises a feeding pump and control valves, for example, for limiting the pressure level and leading it, for example, back to the tank. The flow of hydraulic fluid from a channel T (port T) into the chamber 10 is controlled by a control valve 27, which is used as a suction valve in this example. A corresponding coupling is also provided for other chambers in a functional block 14, one of the control valves of a functional block 24 being coupled to each chamber. In some cases, two chambers in the same phase may also have a common suction valve.

In this example, the line between the control valve 27 and the chamber 10 is connected to the line L1, but said line may, for example, be connected directly to the chamber 10. In a corresponding manner, it is also possible to connect the other control valves and lines of the functional block 24.

As shown in FIG. 3, a control valve 18 is also connected to the line L1, which control valve is, in this example, used as a pressure control valve when a load is moved upwards by means of an actuator 13. A corresponding coupling is also provided for other chambers in a functional block 14, one of the control valves of a functional block 17 being coupled to each chamber. The control valves pass hydraulic fluid into a channel B (port B) and produce a given volume flow and pressure dependent on the load of the actuator. Two chambers in the same phase may be equipped with a common pressure control valve.

Alternatively, in the device 9 shown in FIG. 3, it is also possible to apply units whose operation is based on pumps which are connected to at least two control valves of the pressure side, for example the control valves 12 and 18. The above-presented principles also apply to this example, but the operation is not cyclic in the same way as, for example, for a piston, wherein the synchronization of the control valves with the internal functionality of the unit will not be necessary.

Figure 12:
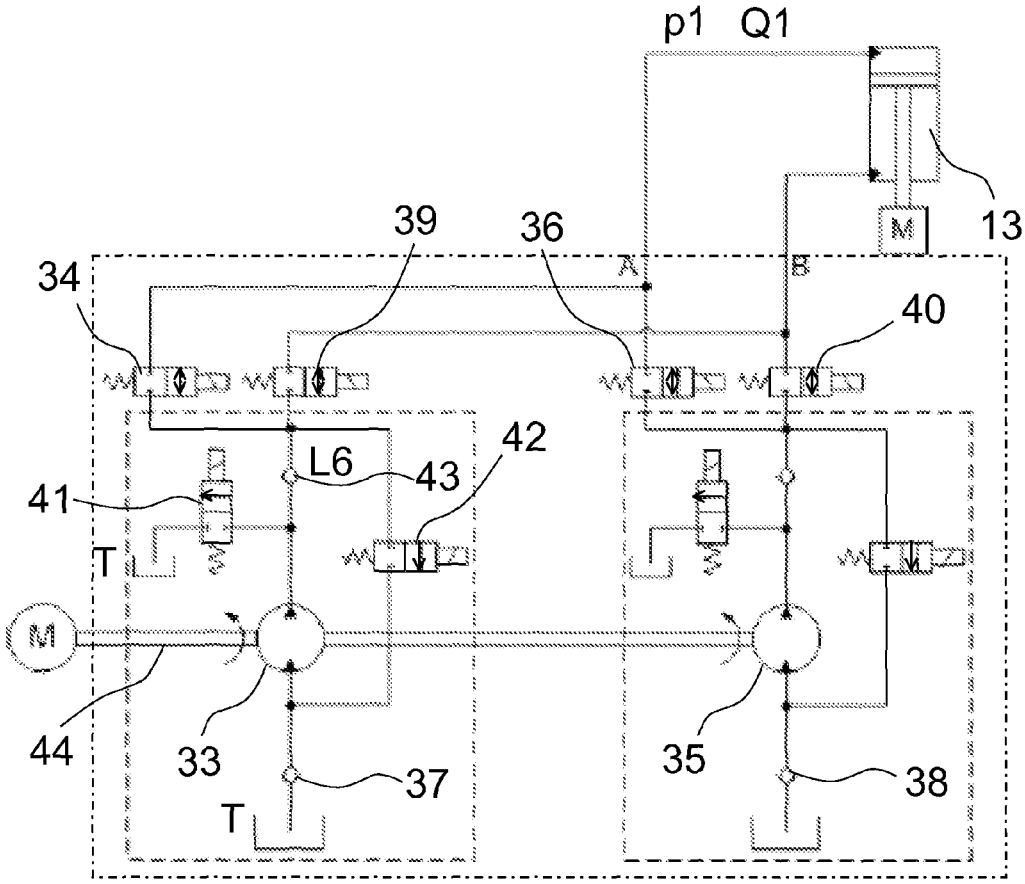
FIG. 12 shows an apparatus and a system according to another example of the invention.

FIG. 12 shows two hydraulic units. The unit comprises a pump 33 whose pressure side is connected to a line L6 (corresponding to the line L1 of FIG. 3), to which also a control valve 34 is coupled (corresponding to the control valve 12 of FIG. 3), which in this example is used as a pressure control valve when the load is moved downwards by the actuator 13. A corresponding coupling is provided for the pumps of the other units (pump 35), a control valve being coupled to each pump (control valve 36). The control valves pass hydraulic fluid into the channel A (port A) and produce a volume flow Q1 and a pressure p1 that is dependent on the load of the actuator 13. The pumps are controlled by one or more driving devices 44, which typically also include an electric motor. From the pumps and control valves of the units shown in FIG. 12, it is possible to compose functional blocks that correspond to those of FIG. 3.

The suction side of pump 33 is connected to a tank, a suction line or, for example, a circuit for supplying hydraulic fluid. The flow of hydraulic fluid from the channel T (port T) into the pump 33 is controlled by a non-return valve 37, which is used as a suction valve in this example. The non-return valve 37 prevents the return of the volume flow from the suction side into the tank. A corresponding coupling is provided for the pumps of the other units (pump 35), a non-return valve being coupled to each pump (non-return valve 38).

A control valve 39 (corresponding to the control valve 18 of FIG. 3) is also coupled to the line L6, which control valve is, in this example, used as a pressure control valve when a load is lifted upwards by means of the actuator 13. A corresponding coupling is provided for the other units as well (control valve 40). The control valves pass hydraulic fluid into the channel B (port B) and produce a given volume flow and pressure dependent on the load of the actuator.

The pressure side of the pump 33 of the unit is connected to a tank via a control valve 41. The valve 41 is in the closed position when volume flow is being supplied into the channel A or B, or open when volume flow is being supplied from the pump 33 into the tank or when volume flow is being received. A non-return valve 43 in the line L6 prevents the supply of volume flow received via the control valves 34, 39 directly onto the suction side of the pump 33 and to the valve 41. The line L6 is connected to the suction side of pump 33 by using a line to which a control valve 42 is coupled, for allowing or preventing the entry of the received volume flow from the control valves 34, 39 onto the suction side of the pump 33. During idle running, in other words, during free circulation, the pump 33 circulates the volume flow from the pressure side to the suction side or leads the volume flow into a tank. The suction side of the pump 33 receives the volume flow via said control valve 42. Said non-return valve 43 also allows the supply of volume flow from the pump 33 to the control valves 34, 39 and 42. In this example, the non-return valve 43 is placed in such a way that the volume flow can enter directly from the pump 33 to the control valve 41.

The couplings of the lines and control valves connected to the pump 33 may also be different from those presented, and the unit will still have the above-mentioned three functional modes.

Figure 8:
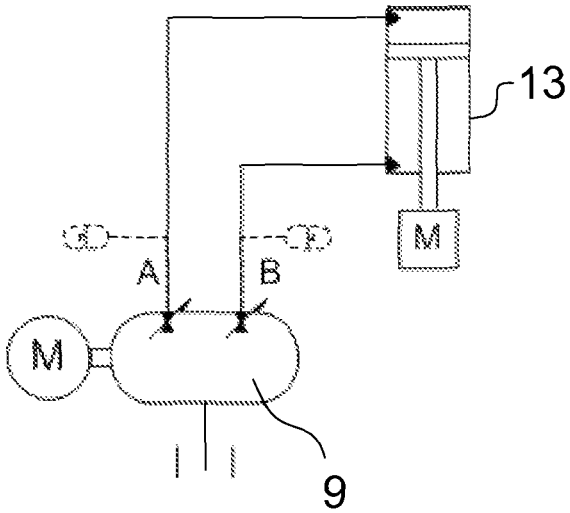
FIGS. 8, 9 and 10 show the application of the apparatus according to the invention in the control of actuators.
Figure 9:
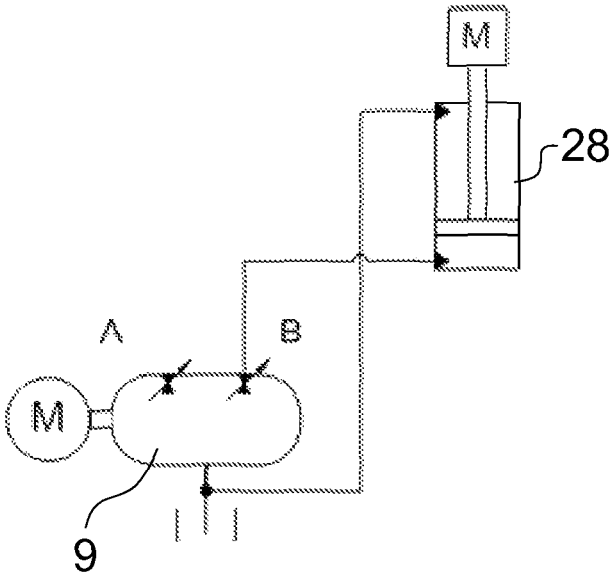
Figure 10:
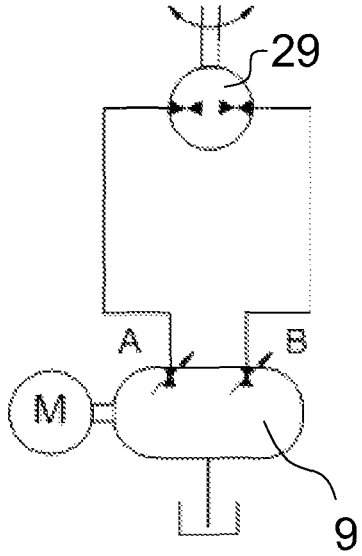

The actuator 13 can be coupled to the apparatus of FIG. 3 as shown in FIG. 8, or in a way similar to the actuator 28 of FIG. 9. The coupling of FIG. 8 corresponds to the coupling of FIG. 3. For levelling out variations in the volume flow and the pressure, in many cases it is also necessary to couple pressure accumulators to the control lines. As shown in FIG. 10, a motor 29 can also be coupled to the channels A and B of the apparatus 9. The direction of rotation of the motor 29 is controlled by leading the volume flow out via channel A or B, and in a corresponding manner, the volume flow is received via channel B or A. The mechanical energy and torque obtained from the shaft of the motor will depend on the pressure difference effective over the motor 29, that is, the pressure difference between the channels A and B. The pressure is obtained from the unit, for example by compressing hydraulic fluid in the chambers and by displacing it via a pressure control valve into the motor 29. The return flow can be utilized in the apparatus 9.

In the example of FIG. 3, opposite chambers of the same cylinder (actuator 13) are coupled to the channels A and B, wherein the return flow from the actuator 13 is also received into the channel A or B. By means of the apparatus 9, hydraulic fluid can be received in such a chamber of the functional block 14 that is expanding. Thus, no hydraulic fluid is sucked via a control valve of the functional block 24 that is kept closed, but the hydraulic fluid is obtained from the actuator 13. In the example of FIG. 3, the external load of the actuator 13 is effective so that pressurized hydraulic fluid is received in channel B and the pressure assists in the movement of the piston in, for example, the chamber 10. The forced movement of the piston can assist in the movement of another piston in the opposite direction, if this is enabled by the driving device 11. If the hydraulic fluid has been, in the above-mentioned case, received in the chamber 10, then upon retraction of the chamber 10 again, the hydraulic fluid can be supplied, for example, via the pressure control valve 12 to the channel A and further to the cylinder 13 whose movement is maintained.

According to the alternative of FIG. 9, the cylinder (actuator 28) is only coupled to the channel B and directly to the tank or a tank line, and an external load moves the cylinder downwards. The hydraulic fluid returning into the channel B is utilized, if desired, in a unit, for example in the chamber 10 (see FIG. 3), after which it can be supplied into a tank. In an example, the hydraulic fluid is led, for example, via control valves 18 and 27 directly into the channel T into the tank. To lift the load controlled by the cylinder, the pressurized hydraulic fluid is led from the desired units into the channel B and further into the actuator 28.

The apparatus 9 and particularly its functional blocks 15 and 24 are controlled by a control device 25. In the case of electronically controlled control valves, for example solenoid-controlled 2/2 directional valves, the control device generates the required voltage signals 31 for activating the desired valve at a given moment of time. The control device is a microprocessor-based device comprising a memory and control software with control algorithms and settable parameters as well as a user interface for entering the settings. It may also be a computer that comprises the necessary processor and control cards for controlling the valves. Typically, the input of the control device also comprises signals 32 obtained from sensors and indicating, for example, the phase in which the chamber of the functional block 14 are. Information is obtained, for example, from the shaft of the driving device 11.

Information on the position or pressure level of the actuator is also obtained from a sensor. If necessary, the controlling voltage signals are synchronized with the operation of the units in accordance with a predetermined control algorithm. In the control device, for example, a given sequence is determined for the functions of the actuator to be controlled by means of sensors or a feedback coupling. Consequently, the control algorithm can be implemented in a variety of ways according to the function required of the actuators, and depending, for example, on the utilization of the units, for example, in the return flow of the hydraulic fluid.

Figure 4:
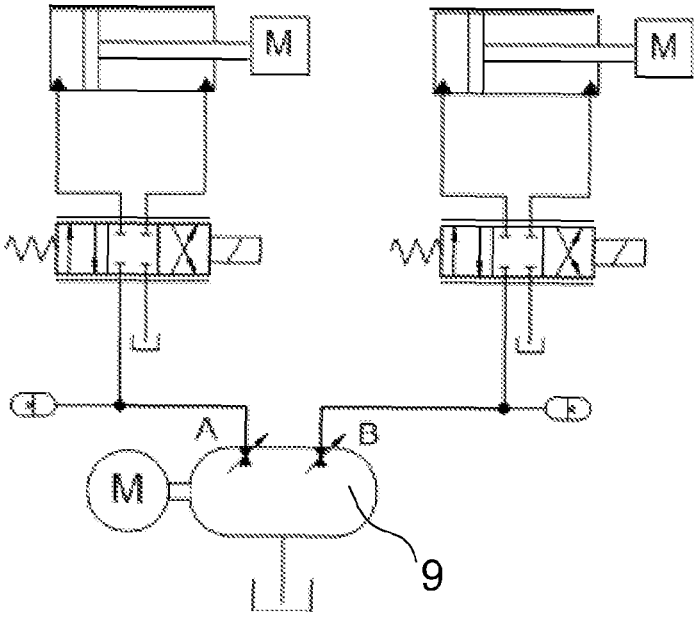
FIGS. 4 and 5 show the application of the apparatus according to the invention when there are two separate control circuits.
Figure 5:
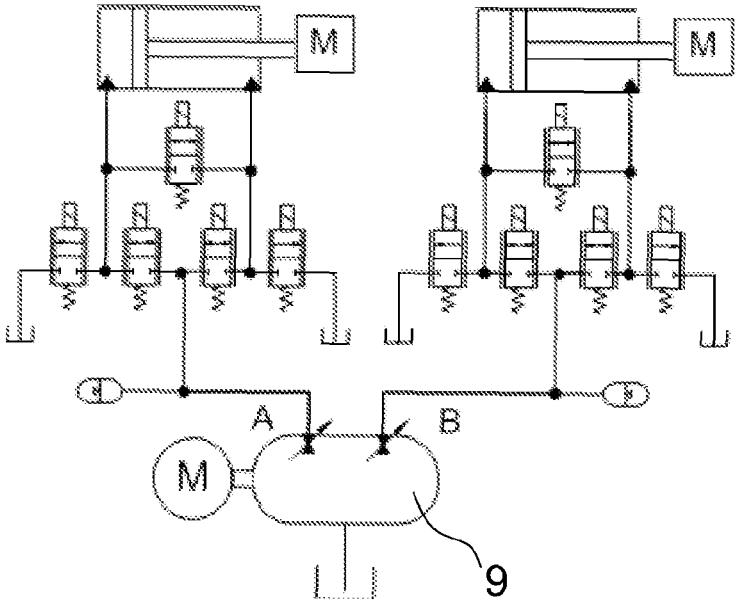

FIG. 4 shows that the apparatus 9 can be utilized as a pump for the control circuit for two separate actuators. The speed and direction of movement of the actuators are controlled by a proportional directional valve. The apparatus is driven, for example, by pressure control, keeping the pressures to the proportional valves suitable in the input lines. The pressure and the volume flow are determined separately for each control circuit, but the apparatus 9 is common to the actuators. Furthermore, it should be noted that the same unit, for example chamber 10, may produce volume flow and pressure for both actuators but at different times. In other words, the control valves 12 and 18 (FIG. 3) are not open at the same time. FIG. 5 shows the separate control circuits of the actuators of FIG. 4 utilizing proportionally controlled 2/2 directional valves.

Figure 6:
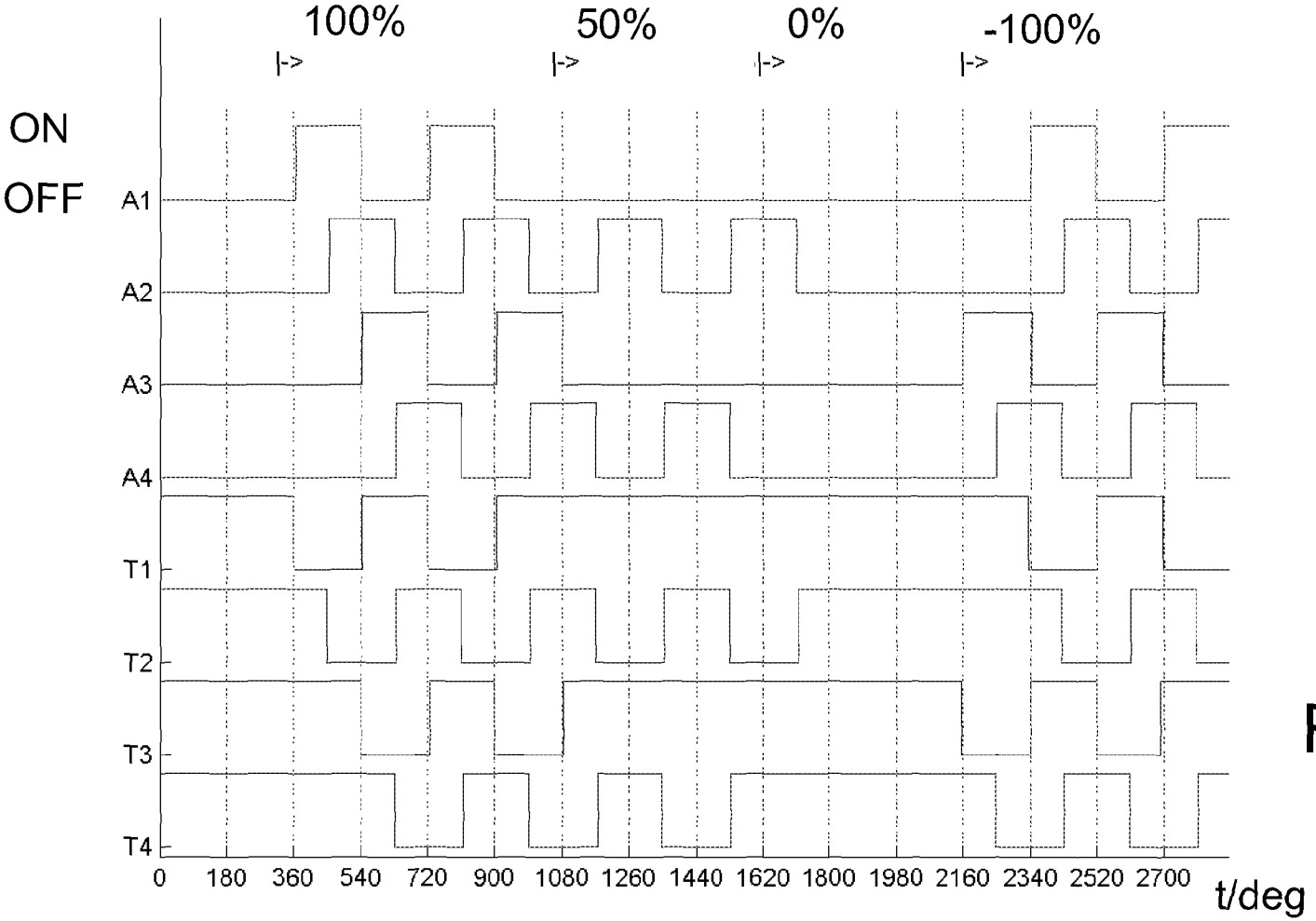
FIG. 6 shows the timing chart of the apparatus according to an example of the invention.

FIG. 6 shows, in more detail, the timing of the valves in an apparatus in an example in which the apparatus comprises four chambers, pressure valves A1, A2, A3, and A4 (corresponding to the functional block 15 of FIG. 3), and suction valves T1, T2, T3, and T3 (corresponding to the functional block 24). The horizontal axis indicates the rotational angle of the apparatus operating in a cyclic manner, connected to time. The chambers have a phase shift of 90°, and a corresponding phase shift is also provided in the pressure control valves which supply volume flow into the channel A when the piston displaces hydraulic fluid from the chamber. With the rotational angle of 1080, the production of the apparatus used as a pump drops to the value of 50%, wherein half of the chambers are switched to running idle, wherein the pressure control valves of said chambers remain closed and the suction valves open. With the rotational angle of 1710, all the chambers of the apparatus turn to running idle, and the production of the pump drops to the value of 0%. With the rotational angle of 2160, all the chambers of the apparatus used as a motor are in operation, and a volume flow is supplied from the channel A via the pressure control valves into the chambers, when the piston is making a return movement. As seen in the figure, there is a phase shift of 180° between the pump function and the motor function in the operation of the valves.

Figure 7:
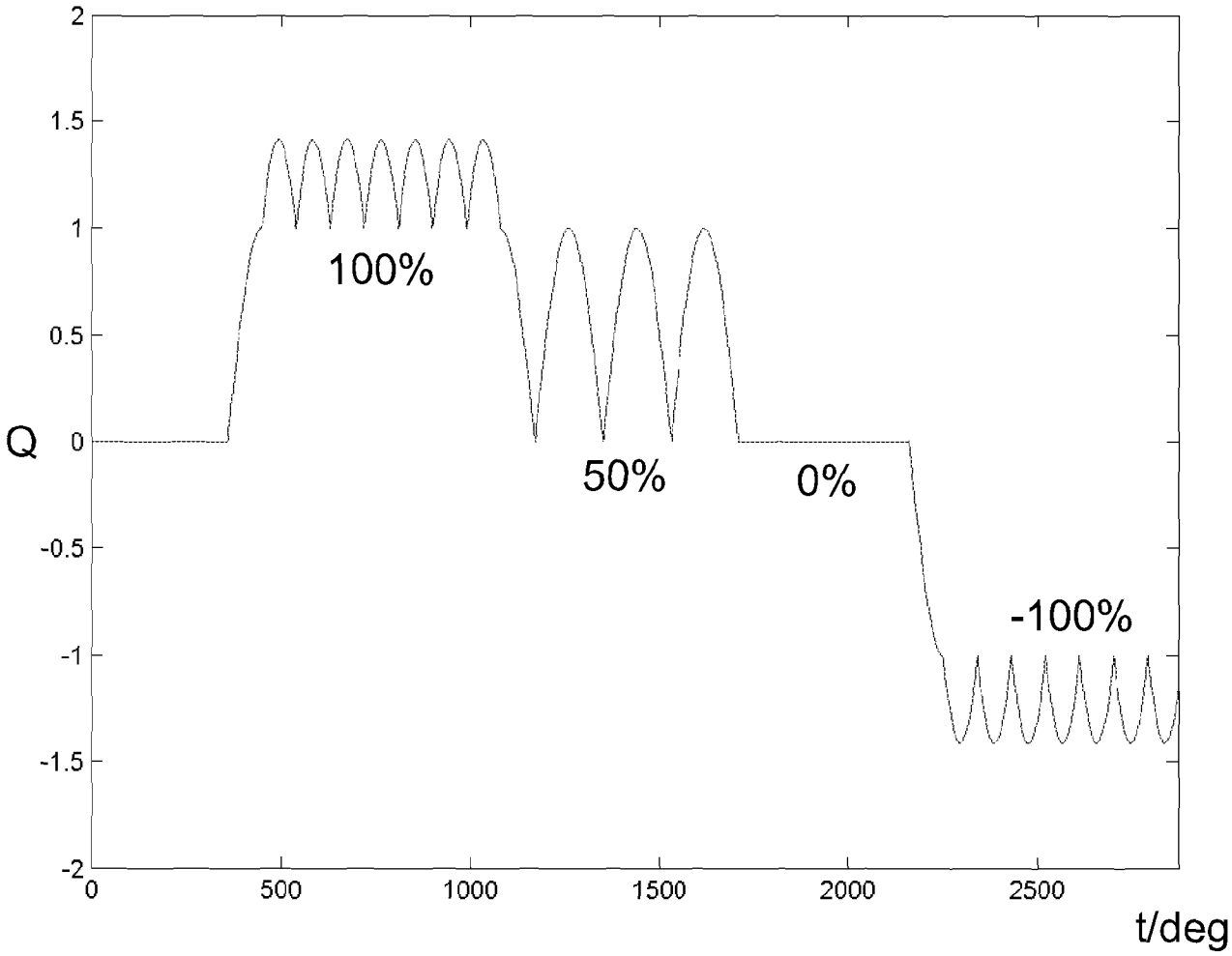
FIG. 7 shows the volume flow produced by the apparatus according to an example of the invention.

FIG. 7 illustrates the theoretical volume flow produced by the apparatus shown in FIG. 6 and used as a pump, with the angle of rotation from 360 to 1080 (100% production) and the angle of rotation from 1080 to 1620 (50% production), as well as the angle of rotation from 1710 to 2160 (0% production). The curve of FIG. 7 also shows the pulsation of the volume flow due to the cyclic feature and the different timing of the chambers which can be levelled out by supplementing the control circuit with a pressure accumulator. With the rotational angle of 2160, the apparatus starts to function as a motor, so that volume flow is received, which is shown as negative production (−100% production).

Figure 11:
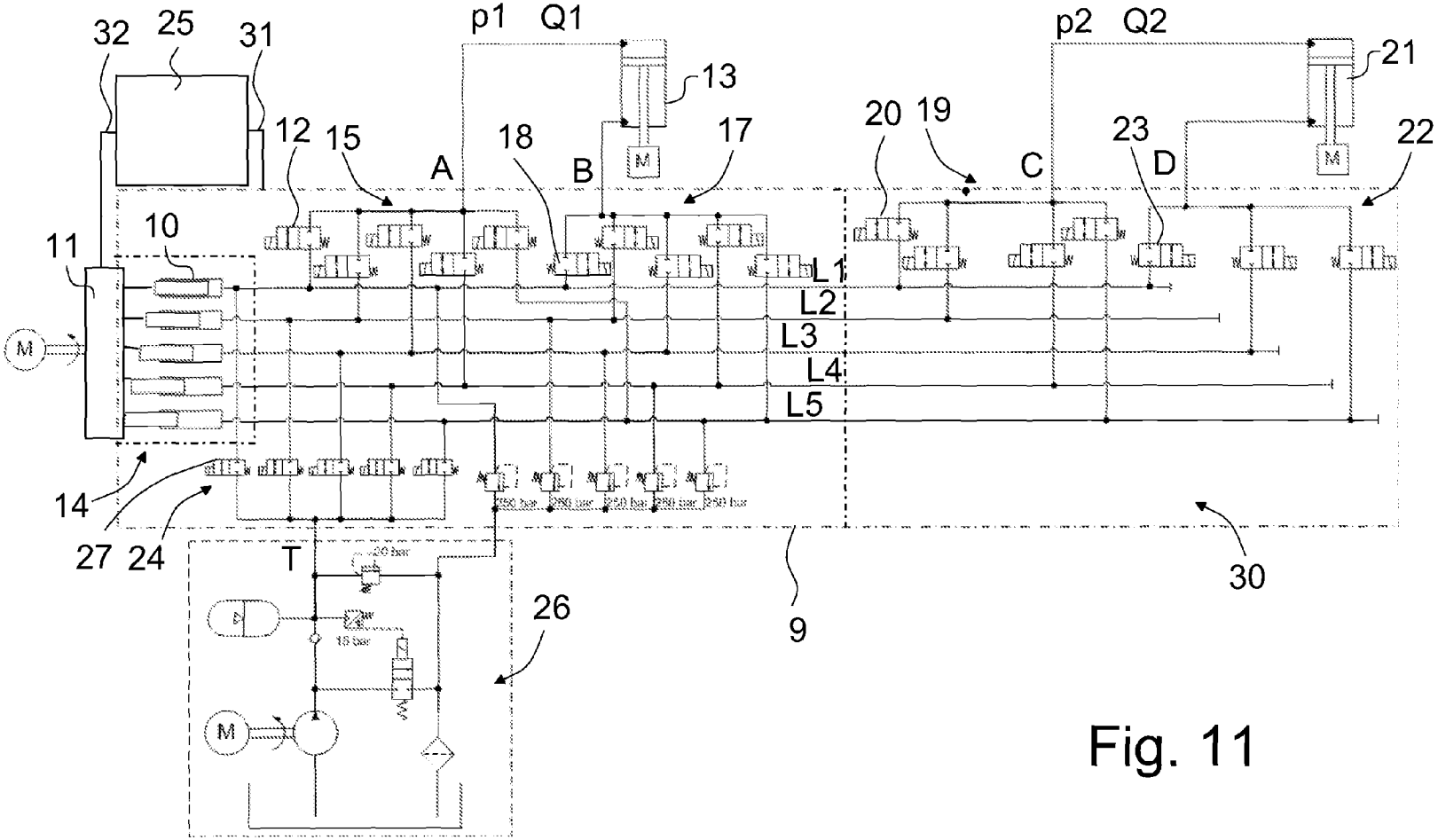
FIG. 11 shows an apparatus and a system according to another example of the invention.

FIG. 11 shows yet another example of the apparatus 9 which has been expanded by two additional channels C and D (port C, port D) of the functional block 30, which ports can be used in the same way as the channels A and B, as presented above. In some lines L1-L5 there are two or more control valves; for example, in line L1, there are control valves 12, 18, 20, and 28, which belong to the functional block 15, 17, 19, or 22. The number and structure of the control valves in the functional block. 30 vary. If the actuator 21 only needs a small volume flow Q2, the functional block 19 may have fewer control valves than the total number of units. The apparatus may also comprise units provided with one control valve only. The functional block 30 may comprise one or more control valves for each line. For example, the chamber 10 can thus be used for producing alternately, on one hand, part of the volume flow Q1 and the pressure p1 and, on the other hand, part of the volume flow Q2 and the pressure p2. The valves 12 and 20 are not open simultaneously.

According to FIGS. 3 and 11, the unit of the apparatus 9 is a chamber operating by the principle of displacement and always connected to one control valve of the suction side. The unit is connected to at least two control valves of the pressure side which are controlled in synchronization with the operation of the unit. As shown in FIG. 3, the unit thus comprises the chamber 10, the control valve 27, and the necessary channels. The driving members 11 and at least the control valves 12, 18 are connected to the unit. The unit produces a volume flow when the chamber 10 is becoming smaller and the control valve 27. The unit receives a volume flow when the chamber 10 is expanding and the control valve 27 is closed. The unit is running idle when the control valve 27 is kept open and the piston moves back and forth.

As shown in FIG. 12, the unit is a pump connected to the valves controlling the functional modes of the unit. The unit is connected to at least two control valves of the pressure side. According to the example of FIG. 12, the unit thus comprises a pump 33, control valves 41 and 42, and non-return valves 37 and 43. The driving members 44 and at least the control valves 34, 39 are connected to the unit. The unit produces a volume flow when the pump 33 is operating and the control valves 41, 42 are closed. The unit receives a volume flow when the pump 33 is operating and the control valves 41, 42 are open. The unit is running idle when the control valve 42 or the control valve 41 is open and the pump 33 is in operation.

The structure of the unit may also deviate from the examples presented above. The function of the unit comprises at least three functional modes. First of all, the unit is capable of producing a volume flow. Secondly, the unit is capable of receiving a volume flow from the ports. Thirdly, the unit is capable of running idle or in free circulation. Preferably, during idle running, hydraulic fluid is transferred or circulated only within the unit, wherein the unit does not produce a volume flow that can be utilized. Preferably, the pressure of the hydraulic fluid in the unit is kept as low as possible, to avoid energy losses.

Typically, the apparatus comprises a series of or several units of the above-presented kind, which operate in synchronization or with phase shifts with respect to each other, if necessary, for example in cycles, but some of the units may operate in the conventional way and be connected to one control valve of the pressure side only. In this description, the term 'several' has the meaning of 'two or more' or 'at least two'. Furthermore, for example, 'a series of units' means that the number of units is 'two or more' or 'at least two'. Some of the units may also be connected to three or more control valves of the pressure side (see the control valves 12, 18, 20, and 23 in FIG. 11). Said unit can be utilized in a variety of ways, for example in the apparatus 9 of FIG. 3.

The components for the apparatus 9 and the control system and the rest of the control circuit relating to it are selected according to the boundary conditions set by the volume flow and pressure aimed at, depending on each application, but the selection will be obvious as such for a person skilled in the art who may apply the basic principles and components of hydraulics known as such in the more detailed application of the components and principles of the apparatus 9.

The invention is not limited solely to the above examples, but it may vary within the scope of the appended claims.

The invention claimed is:

1. An apparatus comprising:

a series of units, each being capable of producing a volume flow, a first channel for supplying hydraulic fluid into the apparatus, a second channel for supplying hydraulic fluid from the apparatus, a first series of valves comprising at least one controlled valve for each unit, by means of which valves the supply of volume flow from each unit to the second channel can be prevented and allowed, a third channel for supplying hydraulic fluid from the apparatus, several controlled auxiliary valves, each being provided for one unit and used for preventing and allowing the supply of volume flow from said unit to the third channel, and wherein each unit is capable of receiving hydraulic fluid from the second channel by means of the first series of valves and from the third channel by means of the auxiliary valves, wherein:

chamber operating by the principle of displacement, the chamber being connected by means of a line to at least one valve of the first series of valves and to at least one auxiliary valve of the auxiliary valves, and wherein the chambers are controllable for synchronized operation for producing a desired total volume flow to the second channel and to the third channel.

2. The apparatus according to claim 1, wherein each unit is also capable of running idle such that each unit does not produce a volume flow to the second channel and to the third channel and does not receive hydraulic fluid from the second channel and from the third channel.

3. The apparatus according to claim 1, wherein the apparatus further comprises:

a control device configured to synchronize the operation of the valves of the first series of valves and said auxiliary valves with the operation of said units, and to control the pressure and the volume flow in a predetermined manner, for controlling one or more actuators.

4. The apparatus according to claim 3, wherein the control device is configured to produce pressure and volume flow to either the second channel or the third channel only, by using one unit that belongs to said series of units.

5. The apparatus according to claim 3, wherein the control device is configured to produce pressure and volume flow alternately to both the second channel and the third channel, by using one unit that belongs to said series of units.

6. The apparatus according to claim 1, wherein the apparatus further comprises a second valve series comprising at least one controllable valve for each unit, by means of which valves the suction of hydraulic fluid into each unit from the first channel can be prevented and allowed.

7. The apparatus according to claim 6, wherein the apparatus further comprises:

a control device configured to synchronize the operation of the valves of the first and second series of valves and said auxiliary valves with the operation of said units, and to control the pressure and the volume flow in a predetermined manner, for controlling one or more actuators.

8. The apparatus according to claim 6, wherein the return of hydraulic fluid from at least one unit to the first channel can be prevented and allowed by means of said second series of valves.

9. The apparatus according to claim 1, wherein for changing the direction of movement of the actuator, or for controlling a separate actuator, the return of the volume flow from the third channel to at least one unit can be prevented and allowed by means of said auxiliary valves.

10. The apparatus according to claim 1, wherein for changing the direction of movement of the actuator, or for controlling a separate actuator, the return of the volume flow from the second channel to at least one unit can be prevented and allowed by means of said first series of valves.

11. The apparatus according to claim 1, wherein the apparatus further comprises:

driving members, to which a driving motor can be coupled and by means of which said series of units is driven.

12. An apparatus comprising:

a series of units, each being capable of producing a volume flow, a first channel for supplying hydraulic fluid into the apparatus, a second channel for supplying hydraulic fluid from the apparatus, a first series of valves comprising at least one controlled valve for each unit, by means of which valves the supply of volume flow from each unit to the second channel can be prevented and allowed, a third channel for supplying hydraulic fluid from the apparatus, several controlled auxiliary valves, each being provided for one unit and used for preventing and allowing the supply of volume flow from said unit to the third channel, and wherein each unit is capable of receiving hydraulic fluid from the second channel by means of the first series of valves, and from the third channel by means of the auxiliary valves, wherein:

each unit comprises at least a pump comprising a pressure side to which the pump produces a volume flow, and a suction side from which the pump receives hydraulic fluid, wherein the pressure side is connected to at least one valve of the first series of valves and to at least one auxiliary valve of the auxiliary valves, and wherein the suction side is connected to the first channel, to said at least one valve of the first series of valves and to said at least one auxiliary valve of the auxiliary valves.

13. The apparatus according to claim 12, wherein the unit further comprises at least one controllable valve, by means of which the supply of volume flow from the pressure side of the pump, from the second channel and from the third channel to the suction side of the pump can be prevented and allowed, and at least one controllable valve, by means of which the supply of the volume flow from the pressure side of the pump to the first channel, a tank or a tank line can be prevented and allowed.

14. The apparatus according to claim 12, wherein the apparatus further comprises:

a control device configured to synchronize the operation of the valves of the first series of valves and the auxiliary valves with the operation of the units, and to control the pressure and the volume flow in a predetermined manner, for controlling one or more actuators.

15. A control circuit, comprising:

a series of units, each being capable of producing a volume flow, a first channel for supplying hydraulic fluid into the control circuit, at least one actuator for converting hydraulic energy to mechanical energy, a second channel to which the actuator is connected for supplying hydraulic fluid to said actuator, a first series of valves comprising at least one controlled valve for each unit, by means of which valves the supply of the volume flow from each unit to the second channel can be prevented and allowed, wherein the control circuit further comprises:

a third channel to which the actuator is also connected for returning hydraulic fluid from said actuator, several controlled auxiliary valves, each being provided for one unit and used for preventing and allowing the return of hydraulic fluid from the third channel into at least one unit of the series of units, a control device configured to synchronize the operation of the valves of the first series and said auxiliary valves with the operation of said units, and to control the actuator in a predetermined manner by means of the pressure and volume flow of the control circuit, and wherein each unit is further capable of receiving hydraulic fluid from the second channel by means of the first series of valves, and from the third channel by means of the auxiliary valves.

16. The control circuit according to claim 15, wherein each unit is also capable of running idle such that each unit does not produce a volume flow to the second channel and to the third channel and does not receive hydraulic fluid from the second channel and from the third channel.

17. The control circuit according to claim 15, wherein the number of said auxiliary valves is at least one for each unit of the series of units.

18. The control unit according to claim 15, wherein the apparatus further comprises:

one or more units, each being capable of producing a volume flow, each being connected to either the second channel or the third channel.

19. The control circuit according to claim 15, wherein for changing the direction of movement of the actuator, the return of the volume flow from said actuator via the third channel to at least one unit can be prevented and allowed by means of said auxiliary valves, and the return of the volume flow from said actuator via the second channel to at least one unit can be prevented and allowed by means of said first series of valves.

20. The control circuit according to claim 15, wherein the control circuit also comprises driving members, to which a driving motor is coupled and by means of which said series of units is driven, and a supply circuit of hydraulic fluid or a reservoir of hydraulic fluid, connected to the first channel.

21. A method for producing pressure and volume flow, comprising:

driving a series of units, each being capable of producing a volume flow, supplying hydraulic fluid into a first channel, supplying a volume flow from a second channel to an actuator which is connected to the second channel, controlling, by allowing and preventing, the supplying of volume flow from each unit into the second channel by controlling a first series of valves, comprising at least one controlled valve for each unit, wherein the method further comprises:

returning hydraulic fluid from the actuator to a third channel which also is connected to the actuator, controlling, by allowing and preventing, the return of hydraulic fluid from the third channel to at least one unit of the series of units by controlling several auxiliary valves, each being provided for one unit, synchronizing the operation of the first series of valves and said auxiliary valves with the operation of said units, and controlling the pressure and the volume flow in a predetermined manner, for controlling the actuator by means of a control device, wherein each unit is capable of receiving hydraulic fluid from the second channel by means of the first series of valves, and to supply the volume flow to the third channel by means of the auxiliary valves.

22. The method according to claim 21, wherein each unit is also capable of running idle such that each unit does not produce a volume flow to the second channel and to the third channel and does not receive hydraulic fluid from the second channel and from the third channel.

23. The method according to claim 21, wherein each unit is capable of receiving hydraulic fluid from the second channel and from the third channel at different times.

24. The method according to claim 21, wherein the method further comprises:

changing the direction of movement of the actuator by means of the supply of the volume flow from the third channel to the actuator and by means of the return of volume flow from the actuator to the second channel, controlling, by allowing and preventing, the supply of the volume flow from each unit to the third channel by means of controlling said auxiliary valves, controlling, by allowing and preventing, the return of the volume flow from said actuator via the second channel into at least one unit by means of said first series of valves.

* * * * *